US005983992A

United States Patent [19]

Child et al.

[11] Patent Number: 5,983,992

[45] Date of Patent: Nov. 16, 1999

[54] UNIT CONSTRUCTION PLATE-FIN HEAT EXCHANGER

[75] Inventors: Malcolm S. Child, Arlington, Mass.; James B. Kesseli, Mont Vernon, N.H.; James S. Nash, West Newbury, Mass.

[73] Assignees: Northern Research; Engineering Corp., both of Woburn, Mass.

[21] Appl. No.: 09/239,647

[22] Filed: Jan. 29, 1999

Related U.S. Application Data

[63] Continuation of application No. 08/792,261, Jan. 31, 1997, abandoned

[60] Provisional application No. 60/010,998, Feb. 1, 1996.

[51] Int. Cl.[6] ..... F28D 1/03

[52] U.S. Cl. ..... 165/81; 165/153; 165/167

[58] Field of Search ..... 165/153, 81, 175, 165/82, 83, 167

[56] References Cited

U.S. PATENT DOCUMENTS

| | | | |
|---|---|---|---|
| 2,566,310 | 9/1951 | Burns et al. | 165/167 X |
| 2,858,112 | 10/1958 | Gerstung | 165/153 |
| 3,042,382 | 7/1962 | Hryniszak | 165/167 |
| 3,805,889 | 4/1974 | Coolidge | 165/153 |
| 4,134,195 | 1/1979 | Jacobsen et al. | 165/153 X |
| 4,291,752 | 9/1981 | Bridgnell | 165/81 |
| 4,291,754 | 9/1981 | Morse et al. | 165/167 X |
| 4,815,532 | 3/1989 | Sasaki et al. | 165/153 X |
| 4,869,317 | 9/1989 | Jubb et al. | 165/167 X |
| 4,917,181 | 4/1990 | Kiernan, Jr. et al. | 165/81 X |

FOREIGN PATENT DOCUMENTS

| | | | |
|---|---|---|---|
| 1494167 | 9/1967 | France | 165/153 |
| 236491 | 6/1969 | U.S.S.R. | 165/167 |
| 347547 | 6/1970 | U.S.S.R. | 165/153 |
| 1304691 | 1/1970 | United Kingdom | 165/153 |
| 1254372 | 11/1971 | United Kingdom | 165/153 |

*Primary Examiner*—Leonard Leo
*Attorney, Agent, or Firm*—Michael H. Minns; Michael M. Gnibus

[57] ABSTRACT

A heat exchanger for transferring heat between an external fluid and an internal fluid includes two or more heat exchange cells, each heat exchange cell having a top plate with an inlet aperture at one end thereof and an outlet aperture at the other end thereof, the top plate including a first surface, a second surface and peripheral edges. The heat exchange cell also includes a bottom plate juxtaposed with the top plate, the bottom plate having an inlet aperture at one end thereof and an outlet aperture at the other end thereof. The bottom plate includes a first surface, a second surface and peripheral edges. The peripheral edges of the top and bottom plates are attached to one another, the second surfaces of the top and bottom plates confronting one another and the inlet and outlet apertures of the top and bottom plates being in substantial alignment with one another. The attached top and bottom plates define a high pressure chamber between the second surfaces thereof. The inlet and outlet apertures of the top and bottom plates including substantially curvilinear S-shaped raised flange portions extending away from the first surfaces of the plates, the substantially curvilinear S-shaped raised flange portions terminating at interior edges bounding the apertures. Each heat exchange cell includes an internal finned member disposed between and attached to the second surfaces of the respective top and bottom plates, wherein the individual heat exchange cells are assembled one atop the other with the interior edges of adjacent heat exchange cells attached together for forming a compliant bellows structure capable of elastically absorbing deflections produced during thermal loading so that the heat exchange cells may move and flex relative to one another.

26 Claims, 12 Drawing Sheets

UNIT CONSTRUCTION PLATE-FIN HEAT EXCHANGER

Pursuant to 37 C.F.R. Section 1.53(b), this is a continuation of U.S. Patent application Ser. No. 08/792,261 filed Jan. 31,1997, now abandoned which, in turn, claims benefit under 35 U.S.C. Section 119(e) of U.S. Provisional Application No. 60/010,998 filed Feb. 1, 1996. The disclosures set forth in U.S. patent application Ser. No. 08/792,261 and U.S. Provisional Application No. 60/010,998 are hereby incorporated by reference herein.

BACKGROUND OF THE INVENTION

This invention relates generally to plate-fin heat exchangers and more particularly to a counter-flow plate-fin heat exchanger with cross-flow headers used as a recuperator. Plate fin heat exchangers are typically monolithic structures created by brazing their many constituent pieces in a single furnace cycle. This general design presents several problems including the following:

1) A plate fin heat exchanger typically includes hundreds, if not thousands, of brazed joints. Thus, the overall quality of the finished product depends on the reliability of each and every brazed joint so that even one defective brazed joint can result in the entire heat exchanger being scrapped. As a result, assembly methods for plate fin heat exchangers are generally labor intensive as assemblers must avoid the creation of even a single poor braze among thousands in a typical heat exchanger.

2) The dimensions of the constituent parts used to assemble the heat exchanger must be maintained within close tolerances in order that differences in thickness do not compound into gross differences in load during the brazing cycle.

3) Edge bars or closure bars used to carry load through the edges of the heat exchanger make assembly both labor and material intensive and create stiffness and mass discontinuity differences in thermal response time.

With regard to the above design, counterflow plate-fin heat exchangers with crossflow headers typically include a stack of headers sandwiched together to form an alternating gas/air/gas/air header pattern. Each pair of adjacent gas and air headers is separated by a relatively thin parting sheet. Additionally, conventional plate-fin heat exchangers incorporate edge bars or closure bars to seal about the perimeters of the parting sheets and prevent overboard leakage from the high pressure side of the heat exchanger. Inlet and outlet manifold ducts are welded transverse to the edge bars after the headers are assembled and brazed. The edge bars create a stiff and massive structural attachment between the parting sheets. Thermal loading produces faster thermal response in the lighter parting plates than the more massive edge bars. This difference in response time rate combined with the relative weakness of the parting plates can produce damage in the parting plates. Due to differences in the position and structural composition of the parting sheets and edge bars, the temperature changes do not affect the bars and sheets at the same rate. Since the parting sheets are structurally weaker than the edge bars, the parting sheets are strained.

A second problem associated with the use of edge bars in counterflow plate-fin heat exchangers is related to the sheet metal manifold ducts that are welded to the edge bars. The manifolds are welded to the stack of edge bars along the sides and corners of the core adjacent the header openings. Like the parting sheets, the manifold ducts respond quickly to changes in temperature. Since the edge bars do not respond to changes in temperature as quickly as the manifold ducts, the sheet metal experiences a shear load at or near the weld. As a result, the weld and the base metal in the heat affected zone is likely to become damaged.

U.S. Pat. No. 2,858,112 to Gerstung discloses a cross-flow heat exchanger for transferring heat from a liquid (FIG. 1) in which multiple pairs 10 of corrugated plates 12 and 14 are spaced apart by air centering means 16 and heat exchanger or edge bar elements 18 and 20. The edge bar elements 18 and 20 are sandwiched between the aligned header openings 30 and 32 of the respective plates 12 and 14. The utilization of the edge bar elements 18 and 20 adds undesirable rigidity and thermal mass discontinuity to the structure. As a result, the various layers of the structure are unable to move independently of one another during operation. Thus, the heat exchanger disclosed in the Gerstung patent is not appropriate for use with a gas turbine because the exchanger cannot withstand the tremendous temperature extremes produced by a gas turbine.

Great Britain Pat. 1,304,692 to Lowery (FIGS. 1 and 5) discloses a cross-flow heat exchanger for transferring heat from a liquid including a plurality of metal plates 24 shaped and bonded together. The plates 24 have fin members 16 and 17 bonded to their respective outer surfaces. Each plate 24 has two centrally apertured raised end portions 25 and 26 and also has two parallel inverted channels 27 and 28. The respective units are assembled together by placing the next unit in the sequence with its raised end portions 25 and 26 in contact with equivalent raised end portions of the previous unit in the sequence, and by applying pressure to the juxtaposed pair of raised end portions 25 and 26. The relatively large intermeshing surface areas of adjacent raised end portions 25 and 26 results in the formation of rigid flow ducts so that the various layers of the final structure are incapable of moving and flexing relative to one another.

Based on the foregoing limitations known to exist in present plate-fin heat exchangers, it would be beneficial to provide a heat exchanger having a compliant bellows structure capable of elastically absorbing deflections produced by temperature gradients attendant with the heat exchange process and thermal gradients associated with installation or operation, so that the individual layers of the heat exchanger can move and flex freely relative to one another, and can accommodate thermal deflections throughout of plane deformation.

SUMMARY OF THE INVENTION

In accordance with certain preferred embodiments of the present invention, a heat exchanger for transferring heat between an external fluid and an internal fluid includes two or more heat exchange cells. Each heat exchange cell preferably includes a top plate having an inlet aperture at one end thereof and an outlet aperture at the other end thereof, the top plate including a first surface, a second surface and peripheral edges. The heat exchange cell may also include a bottom plate juxtaposed with the top plate having an inlet aperture at one end thereof and an outlet aperture at the other end thereof. The bottom plate also preferably includes a first surface, a second surface and peripheral edges, the peripheral edges of the bottom and top plates being attached to one another, whereby the second surfaces of the top and bottom plates confront one another and the inlet and outlet apertures of the top and bottom plates are in substantial alignment with one another. The aligned inlet apertures and outlet apertures of the respective attached top and bottom plates preferably provide an inlet manifold on one side of the cell and an outlet manifold at the other side of the cell. The inlet and outlet apertures of the top and bottom plates may include substantially S-shaped raised flange portions extending away from the first surfaces of the plates, the substantially S-shaped raised flange portions terminating at interior edges bounding the apertures. The attached top and bottom plates preferably define a high pressure chamber between the second surfaces thereof so that the internal fluid may pass through the heat exchange cell at a higher pressure than the external fluid. The heat exchanger also preferably includes an internal finned member disposed within the high pressure chamber and attached to the second surfaces of said top and bottom plates. The individual heat exchange cells are preferably assembled one atop the other with the adjacent interior edges of adjacent heat exchange cells attached together for forming a compliant bellows structure capable of elastically absorbing deflections produced during thermal loading so that the heat exchange cells may move and flex relative to one another.

In certain preferred embodiments, each heat exchange cell includes an internal finned member and two external finned members, a first one of the two external finned members being attached to the first surface of the top plate and a second one of the two external finned members being attached to the first surface of the bottom plate. Each heat exchange cell is designed for passing the external fluid through the two external finned members in a first flow direction and for passing the internal fluid through the internal finned member in a second flow direction substantially counter to the first flow direction. The internal fluid may be high pressure air passing through the internal finned member and the external fluid may be a low-pressure product resulting from combustion. In other embodiments, the internal fluid may be compressor discharge gases and the external fluid may be turbine discharge gases. During operation of the heat exchange cell, the two external finned members capture heat from the external fluid passing therethrough and transfer the heat to the internal finned member. The internal finned member then transfers the heat to the internal fluid passing therethrough.

Each top plate may include a substantially flat central region between the inlet and outlet apertures thereof and the bottom plate preferably includes a substantially flat central region between the inlet and outlet apertures thereof, the substantially flat central regions of the two plates being in substantial alignment with one another. In certain embodiments, the first one of the two external finned members overlies the substantially flat central region of the top plate, the second one of the two external finned members overlies the substantially flat central region of the bottom plate, and the internal finned member is disposed between the substantially flat central regions of the top and bottom plates. The internal finned member may be in substantial alignment with the two external finned members. The internal finned member is preferably brazed to the second surfaces of the top and bottom plates. In certain preferred embodiments, the first and second external finned members of each heat exchange cell may include substantially aligned leading edges for receiving the external fluid passing between the cell layers and trailing edges for discharging the external fluid after the external fluid has passed therethrough. The substantially aligned leading edges of the first and second external finned members are desirably substantially remote from at least one leading peripheral edge of the heat exchange cell for enabling the peripheral edge to deflect toward and away from a heat exchange cell adjacent thereto. In other preferred embodiments, the substantially aligned leading edges of the first and second external finned members are substantially offset from the aligned outlet apertures for enabling each cell layer to deflect toward and away from a heat exchange cell adjacent thereto. Offsetting the leading edges away from the bellows structure enables the bellows to flex and bend without being constrained by the external finned members. Placing the leading edges of the external finned members away from the at least one leading peripheral edge also reduces thermal forces acting upon the top and bottom plates of each cell.

The trailing edges of the first and second external finned members may also be in substantial alignment with one another, as well as being substantially remote from at least one rear peripheral edge of the heat exchange cell for enabling the cell to move toward and away from a heat exchange cell adjacent thereto. The substantially aligned trailing edges of the first and second external finned members may also be substantially offset from the aligned inlet apertures of the heat exchange cell for enabling each cell to deflect toward and away from a heat exchange cell adjacent thereto. Each heat exchange cell may also include at least one gas turning finned member attached adjacent a peripheral edge of one of the plates for directing the external fluid into a preferred path for impinging upon the two external finned members.

As mentioned above, the internal finned member is desirably disposed in the high pressure chamber of the cell and may have an inlet edge for receiving the first gas from the inlet manifold and an outlet edge for discharging the first gas to the outlet manifold. Each heat exchange cell may also include an inlet manifold finned member disposed in the high pressure chamber between the inlet manifold and the inlet edge of the internal finned member and an outlet manifold finned member disposed in the high pressure chamber between the outlet manifold and the outlet edge of the internal finned member. The inlet and outlet manifold finned members direct the internal fluid in a first direction and the internal finned member directs the internal fluid in a direction substantially perpendicular to the first direction. As mentioned above, heat is generally transferred between the external and internal fluids when the internal fluid passes through the internal finned member. The internal finned member of each cell is adhered to the top and bottom plates for providing resistance against differential pressure load so that no external pre-loading of the heat exchange cell is required.

The top and bottom plates and the substantially S-shaped raised flange portions thereof preferably have a substantially uniform thickness, thereby minimizing the effects of thermal expansion and contraction on the plates. At the outer perimeter of the cell, the substantially S-shaped raised flange portions join together to partially form and define a high pressure chamber, while the inner edges of the substantially S-shaped raised flange portions, i.e., the edges surrounding the inlet and outlet apertures of the attached plates, diverge from one another in each cell so that adjacent inner edges of adjacent cells may be attached together. The adjacent interior edges of the adjacent cells are preferably welded together to form a compliant bellows structure. In highly preferred embodiments, the heat exchange cells are attached to one another solely through the interior edges of the raised flanges. In these embodiments, the sections of the substantially S-shaped raised flanges away from or remote from the interior edges are not attached together. This enables the substantially S-shaped flange portions to independently move and flex in response to compressive, tension and lateral forces.

The foregoing and other aspects will become apparent from the following detailed description of the invention when considered in conjunction with the accompanying drawing figures.

BRIEF DESCRIPTION OF THE DRAWING FIGURES

FIG. 14A shows a front view of the heat exchanger shown in FIG. 13 along line XIV—XIV when the heat exchanger is in an undeflected "cold" state.

DETAILED DESCRIPTION OF PREFERRED EMBODIMENTS

Figure 1:
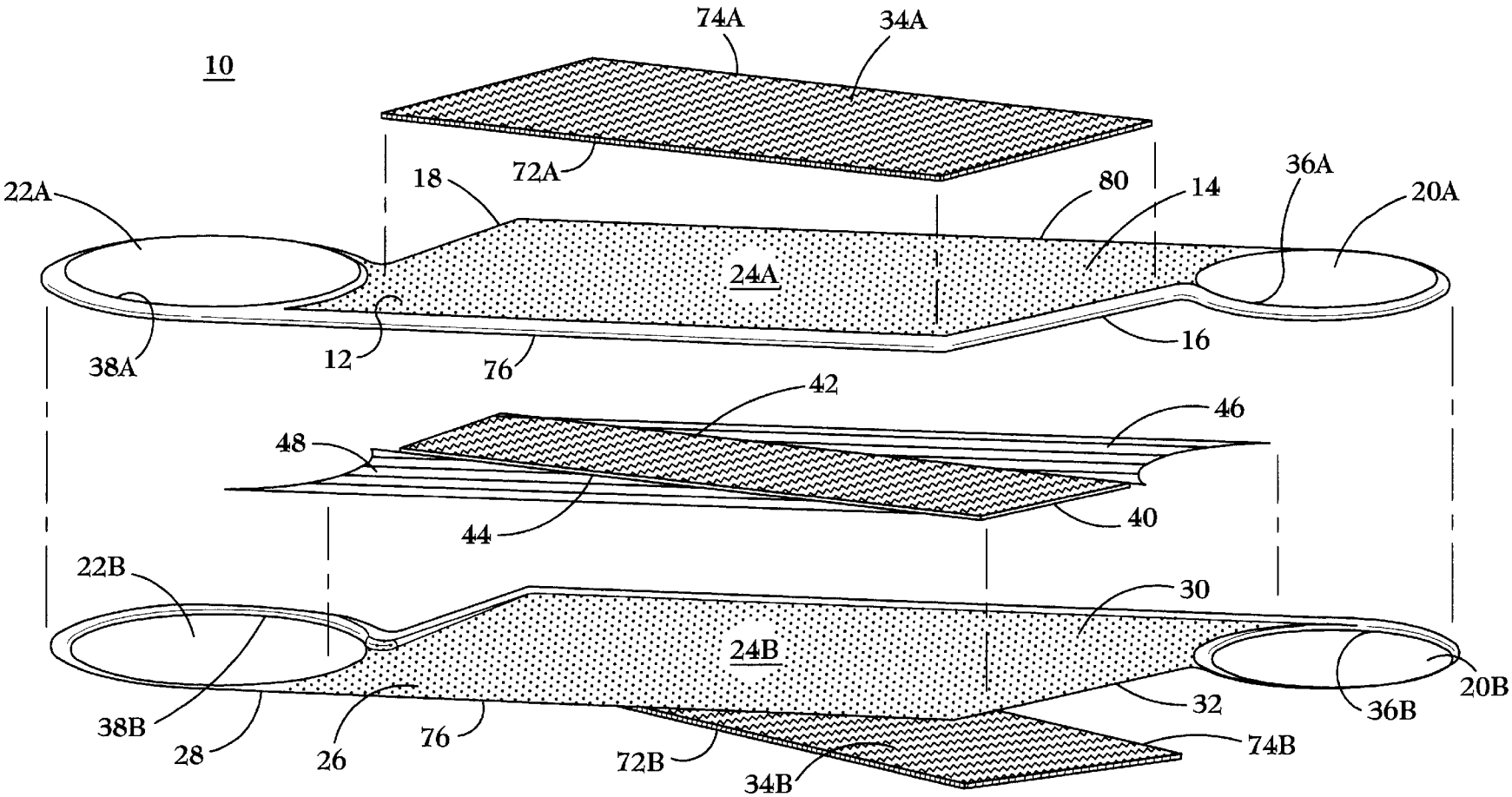
FIG. 1 shows an exploded view of an individual heat exchange cell for a counterflow heat exchanger in accordance with preferred embodiments of the present invention.
Figure 2:
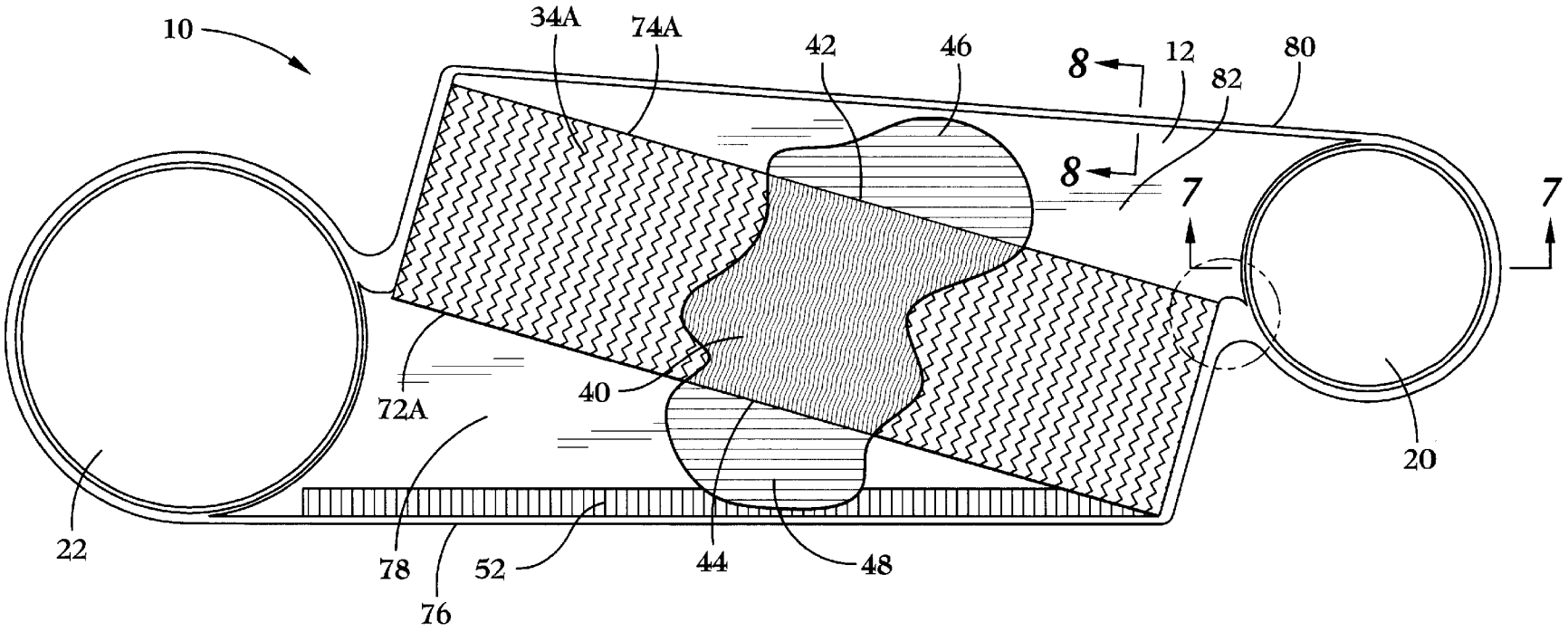
FIG. 2 shows a first plan view of the individual heat exchange cell shown in FIG. 1.

FIG. 1 shows an exploded view of an individual heat exchange cell 10 in accordance with certain preferred embodiments of the present invention. Each heat exchange cell 10 includes a self-contained pressure-tight structure which may be stacked atop other substantially identical heat exchange cells to produce a counterflow heat exchanger, such as the exchanger shown in FIG. 9 and described below. Each heat exchange cell 10 has all of the features required for providing a complete counterflow heat exchanger including inlet and exit manifolds and heat transfer fins assembled into a single unit cell, as shown in FIG. 2.

The utilization of individual heat exchange cells overcomes the following problems present in the prior art:

1) Allows for the inspection, correction and/or rejection of a small, manageable heat exchange cell rather than on a completed heat exchanger comprising a matrix of permanently assembled layers, thereby resulting in greater quality control and reduced scrap.

2) Allows for quality-control testing of individual heat exchange cells before the various layers are assembled together, thereby avoiding the risk and technical difficulty of brazing massive heat exchanger matrices.

3) Allows for slip and movement between layers to accommodate for thermal expansion and contraction, without the risk of leakage.

4) Allows for the rapid removal and replacement of defective heat exchange cells, as opposed to scrapping an entire heat exchanger when a defective layer is discovered.

Referring to FIGS. 1 and 2, in certain preferred embodiments, each individual heat exchange cell 10 preferably includes a top plate 12 having a first surface 14, a second surface 16 (FIG. 5) and one or more peripheral edges 18 defining outer edge(s) of the top plate 12. The top plate 12 preferably includes an inlet aperture 20A at one end thereof, an outlet aperture 22A at the other end thereof and a substantially flat central region 24A between the inlet and outlet apertures 20A and 22A. Each heat exchange cell 10 also preferably includes a bottom plate 26 that substantially mirrors the dimensions, size and shape of the top plate 12. The bottom plate 26 preferably has a first surface 28 (FIG. 6), a second surface 30 and one or more peripheral edges 32 defining outer edge(s) of the bottom plate 12. The bottom plate 26 also preferably includes an inlet aperture 20B at one end thereof, an outlet aperture 22B at the other end thereof and a substantially flat central region 24B (FIG. 5) between the inlet and outlet apertures 20B and 22B.

The heat exchange cell 10 preferably includes at least one finned member attached thereto for transferring heat between two or more fluids passing closely by one another. In one particular embodiment, the heat exchange cell 10 preferably includes two external finned members, a first one of the external finned members 34A attached to the first surface 14 of the top plate 12, preferably within the substantially flat central region 24A thereof; and a second one of the two external finned members 34B attached to the first surface 28 of the bottom plate 26, preferably within the substantially flat central region 24B thereof.

The heat exchange cell 10 is preferably assembled by juxtaposing the second surfaces 16, 30 of the top and bottom plates 12, 26 with one another so that the inlet apertures 20A, 20B and the outlet apertures 22A, 22B of the top and bottom plates 12 and 26 are in substantial alignment. The inlet apertures 20A, 20B include respective substantially S-shaped raised flange portions 36A and 36B terminating at interior edges bounding the inlet apertures 20A, 20B. Similarly, the outlet apertures 22A, 22B include respective substantially S-shaped raised flange portions 38A, 38B terminating at interior edges bounding the outlet apertures 22A, 22B. In other words, the substantially S-shaped raised flange portions of the attached top and bottom plates 12 and 26 diverge from one another at the interior edges thereof and are joined at the outer peripheral edges of the plates. Thus, each substantially S-shaped raised flange portion generally extends away from the first surface of the plate associated therewith so that the interior edge thereof lies above the first surface of the plate. In preferred embodiments, the top and bottom plates 12, 26 including the respective substantially S-shaped raised flange portions thereof are of substantially uniform thickness so that temperature changes occurring at the flanges are substantially the same as temperature changes occurring along the remainder of the top and bottom plates 12, 26, whereby thermal strain produced during operation of the heat exchanger is minimized.

The peripheral edges 18, 32 of the respective top and bottom plates 12 and 26 are then attached to one another, whereby the aligned inlet apertures 20A, 20B of the attached top and bottom plates 12 and 26 provide an inlet manifold of the heat exchange cell 10 and the aligned outlet apertures 22A, 22B of the attached top and bottom plates provide an outlet manifold of the heat exchange cell 10. The attached top and bottom plates 12, 26 define a high pressure chamber 52 (FIG. 5) between the second surfaces thereof so that a fluid may pass therethrough at a relatively higher pressure than do fluids passing over the first surfaces of the plates.

The heat exchange cell 10 also preferably includes an internal finned member 40 disposed between and attached to the second surfaces of the top and bottom plates 12, 26. The internal finned member 40 is preferably brazed to the second surfaces 16, 30 of the top and bottom plates 12, 26. When the cell is assembled, the internal finned member 33 is typically in substantial vertical alignment with the two external finned members 34A, 34B, the two external finned members also being in substantial vertical alignment with one another.

Figure 3:
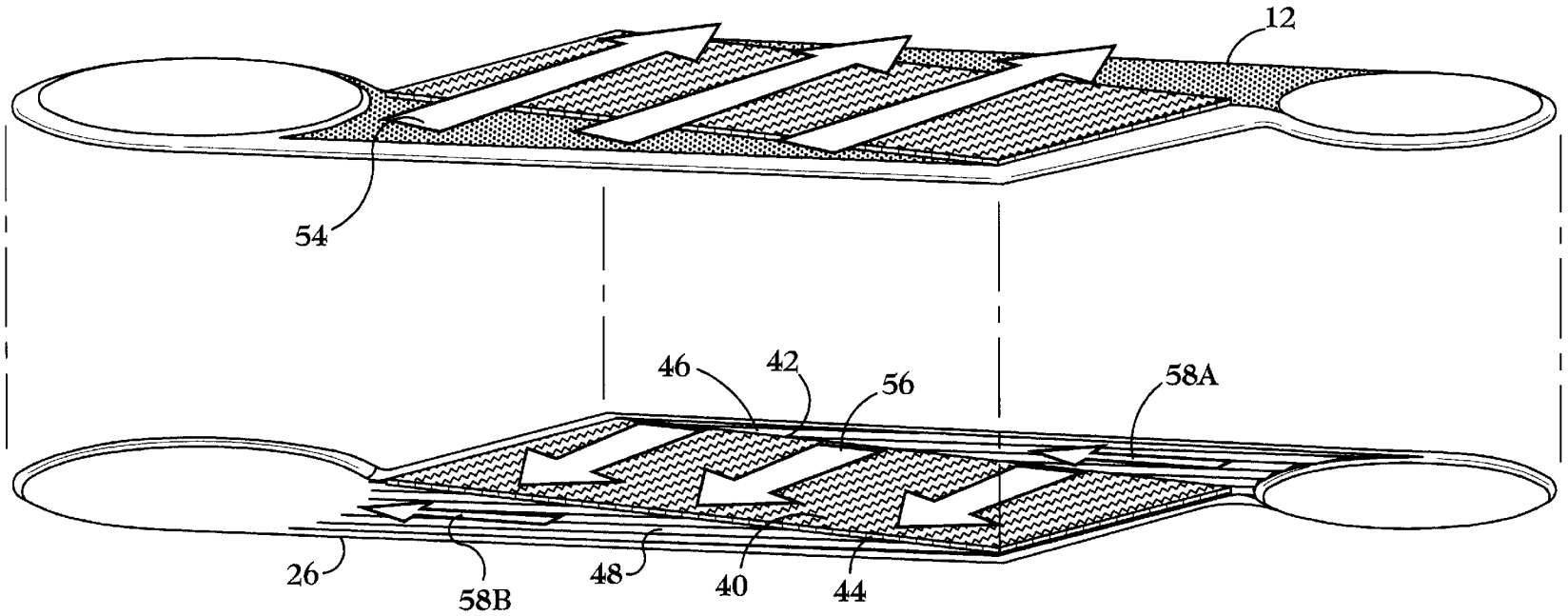
FIG. 3 shows an exploded view of the individual heat exchange cell of FIG. 1 after partial assembly thereof.

Referring to FIG. 3, each heat exchange cell 10 is preferably adapted for passing an internal fluid, such as a combustible gas, through the internal finned member 40 in a first flow direction designated 56 and for passing an external fluid, such as an exhaust gas, through the two external finned members 34 in a second flow direction designated 54 that is substantially counter to the first flow direction 54.

Referring to FIGS. 1–3, the internal finned member 33 attached to the second surfaces of the top and bottom plates 12 and 26 desirably includes an inlet end 42 for receiving the internal fluid from the inlet manifold 20 and an outlet end 44 for discharging the internal fluid to the outlet manifold 22. The heat exchange cell 10 may also include an inlet manifold finned member 46 disposed in the high pressure chamber between the inlet manifold 20 and the inlet edge 42 of the internal finned member 33 and an outlet manifold finned member 48 disposed in the high pressure chamber between the outlet edge 44 of the internal finned member 33 and the outlet manifold 22. As shown in FIG. 3, the inlet and outlet manifold finned members 46, 48 direct the internal fluid in first lateral or crossflow directions 58A, 58B and the internal finned member 33 directs the external fluid in the direction designated 56 that is substantially perpendicular to the first lateral directions 58A, 58B.

Figure 7:
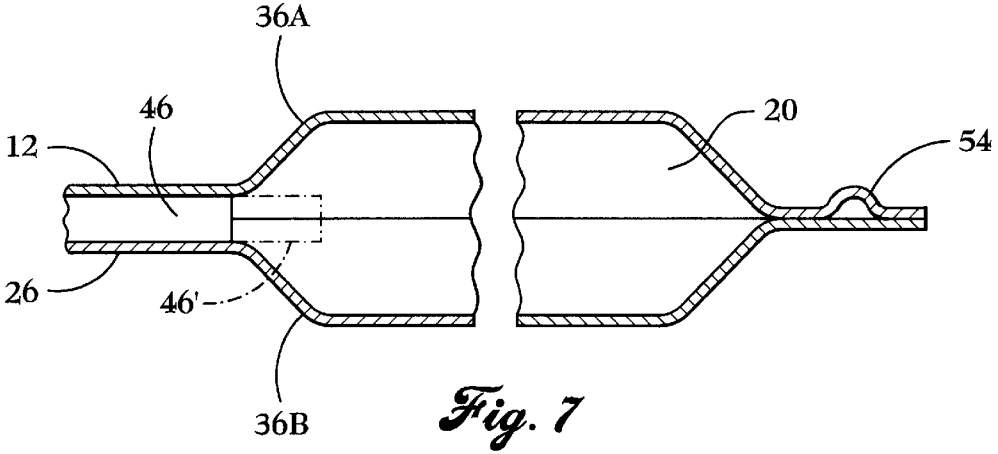
FIG. 7 shows a partial cross-sectional view of the inlet aperture taken along line 7—7 of FIG. 2, showing the raised flanges.
Figure 8:
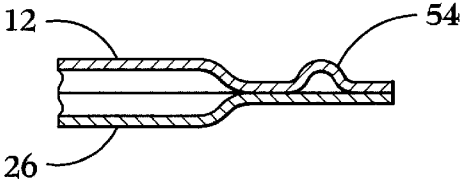
FIG. 8 shows a partial cross-sectional view of an edge of the individual heat exchanger element shown in FIG. 2, taken along line 8—8, showing the details of a braze reservoir.
Figure 4:
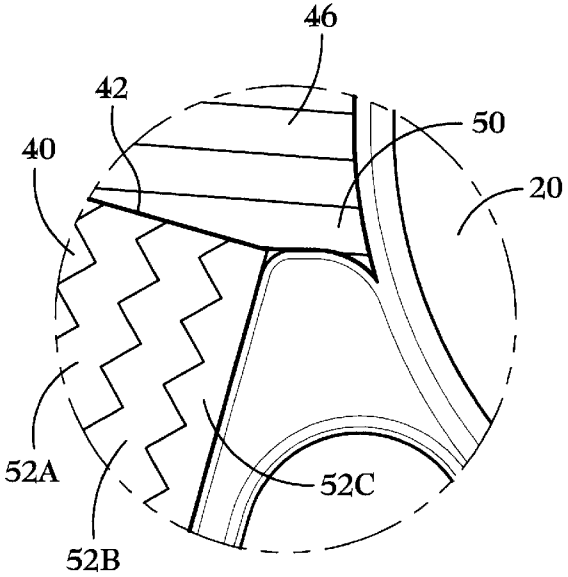
FIG. 4 shows an enlarged fragmentary view of an inlet header of the individual heat exchange cell shown in FIG. 2.

FIG. 4 shows a fragmentary, close-up view of the inlet manifold 20, inlet manifold finned member 46 and internal finned member 33 of a preferred heat exchange cell 10. In this embodiment, the inlet manifold finned member 46 includes a series of channels 50 which serve as conduits for passing the internal fluid from the inlet manifold 20 to the first edge 42 of the internal finned member 33. In preferred embodiments, each channel 50 is in fluid communication with a plurality of channels 52A, 52B, 52C of the internal finned members 33. Referring to FIG. 8, in certain embodiments the inlet manifold fins 46 (or the outlet manifold fins) may terminate at the portion of the top and bottom plates 12 and 26 where the plates diverge to form substantially S-shaped raised flanges 36A, 36B. This termination configuration is shown in solid font in FIG. 7. Alternatively, the inlet manifold fins may extend beyond the portion of divergence of the plates 12, 26 in the manner shown in FIG. 7 by dashed font designated 46'.

Figure 5:
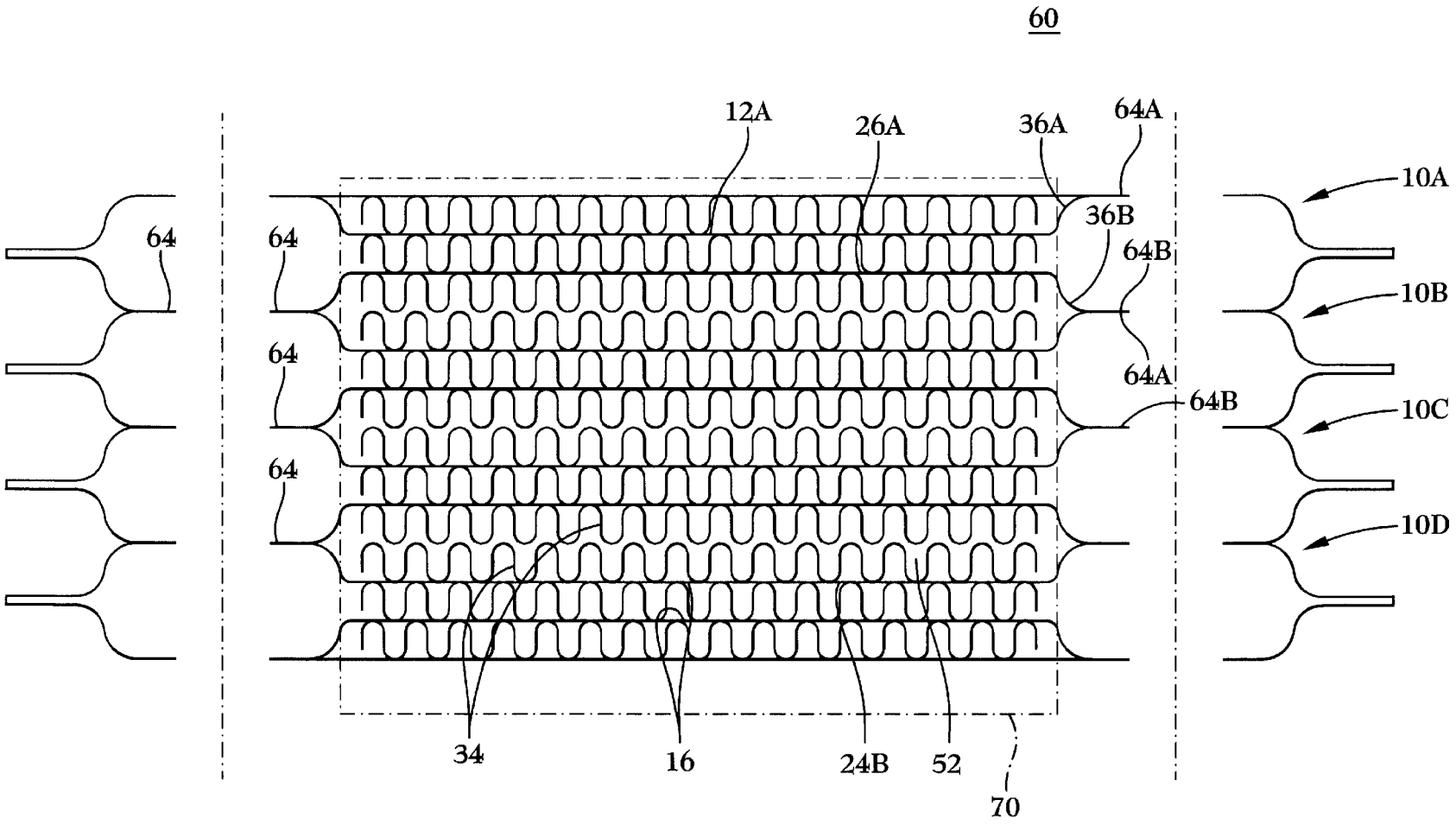
FIG. 5 shows a side view of a counterflow heat exchanger including a plurality of the individual heat exchange cells shown in FIGS. 1–3.
Figure 6:
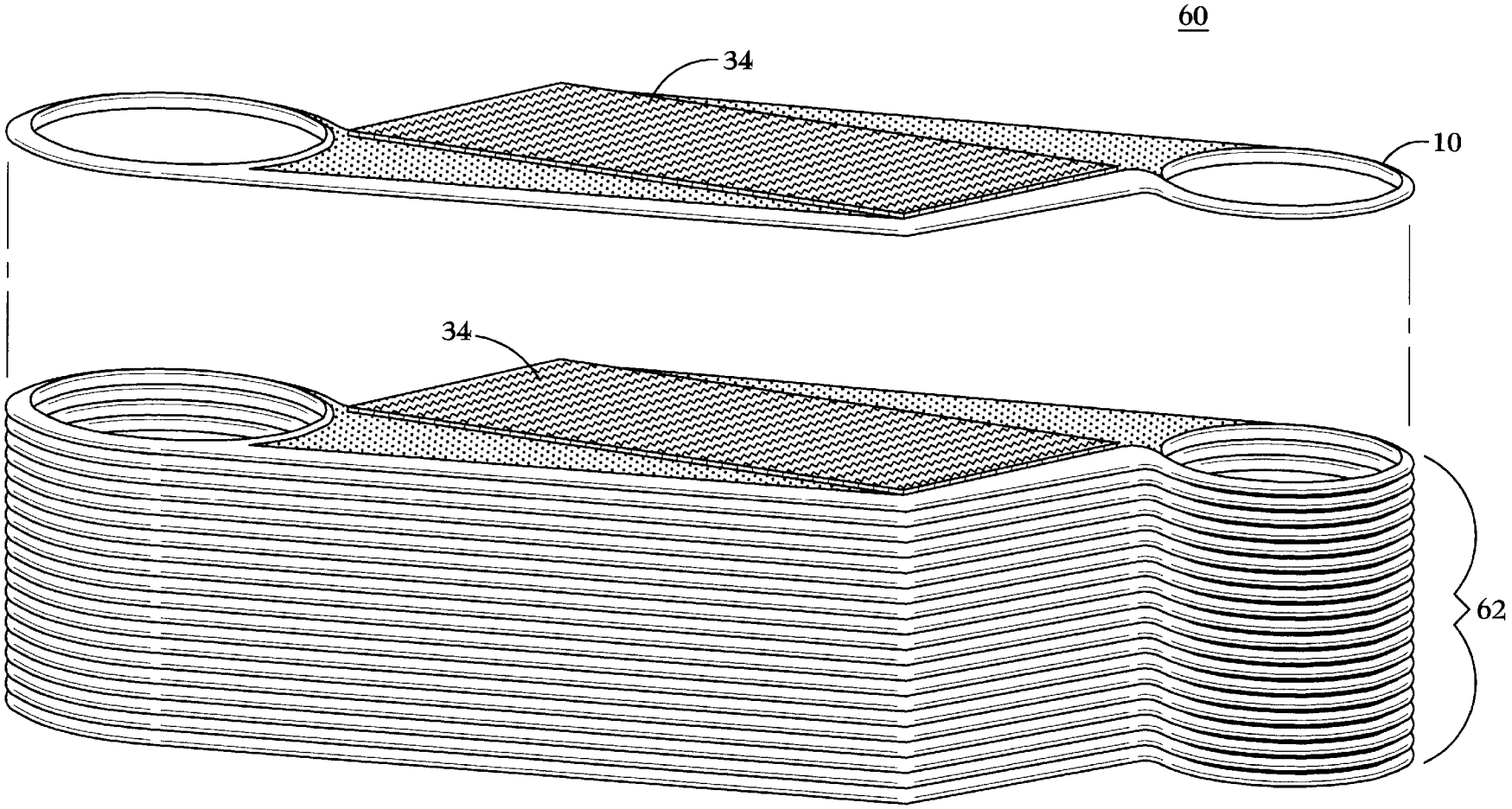
FIG. 6 shows a perspective view of a counterflow heat exchanger including a plurality of the heat exchange cells shown in FIGS. 1–3, in accordance with one preferred embodiment of the present invention.

Referring to FIGS. 5 and 6, in preferred embodiments, a heat exchanger 60 is provided by assembling two or more heat exchange cells 10 one atop the other with the adjacent interior edges of adjacent heat exchange cells attached together for forming a compliant bellows structure 62 capable of elastically absorbing deflections produced during thermal loading so that the individual heat exchange cells may move relative to one another. For example, FIG. 5 shows a heat exchanger including stacked heat exchange cells 10A, 10B, 10C and 10D. Heat exchange cell 10A includes top plate 12A having substantially S-shaped raised flange portion 36A with interior edge 64A and bottom plate 26A having substantially S-shaped raised flange portion 36 B with interior edge 64B. Heat exchange 10B is substantially similar to heat exchange cell 10A and also includes interior edges 64A and 64B. The heat exchange cells 10A and 10B are attached together solely through the adjacent interior edges (e.g., such as by welding the interior edge 64B of heat exchange cell 10A with the interior edge 64A of heat exchange cell 10B). The portions of the substantially S-shaped raised flanges 36 remote from the interior edges 64 are not attached to an adjacent heat exchange cell. This allows the substantially S-shaped raised flanges to flex in response to compression and tension forces. The process is continued until the heat exchange cells 10A–10D are attached together through the adjacent interior edges.

The external finned members 34 of adjacent heat exchange cells 10 are not attached or bonded together so that the individual heat exchange cells are free to move relative to one another during heating up and cooling down of the heat exchanger. As mentioned above, the welded interior edges of the substantially S-shaped raised flanges form a compliant bellows structure capable of elastically absorbing deflections produced during thermal loading so that the individual heat exchange cells may move relative to one another. The compliant nature of the bellows structure minimize stresses and strains placed upon the heat exchanger structure.

In addition, prior art heat exchangers typically include gas header fins adjacent the external finned members 34 attached to the top and bottom plates. The gas header fins are typically provided for 1) directing flow into the heat exchanger matrix; 2) providing compressive strength to react pressure; and 3) providing a continuous load path between the layers during assembly and manufacturing. The present invention does not require such gas header fins due, inter alia, to the fact that each individual cell is pressure balanced (i.e., includes its own internal high pressure chamber so that each individual heat exchange cell may function, if necessary, as a complete heat exchanger). Thus, the absence of gas header fins from the individual heat exchange cells of the present invention provides numerous benefits including providing flexibility to the cell that enables the cell to deflect out-of-plane and thus respond to thermal gradients.

Figure 9:
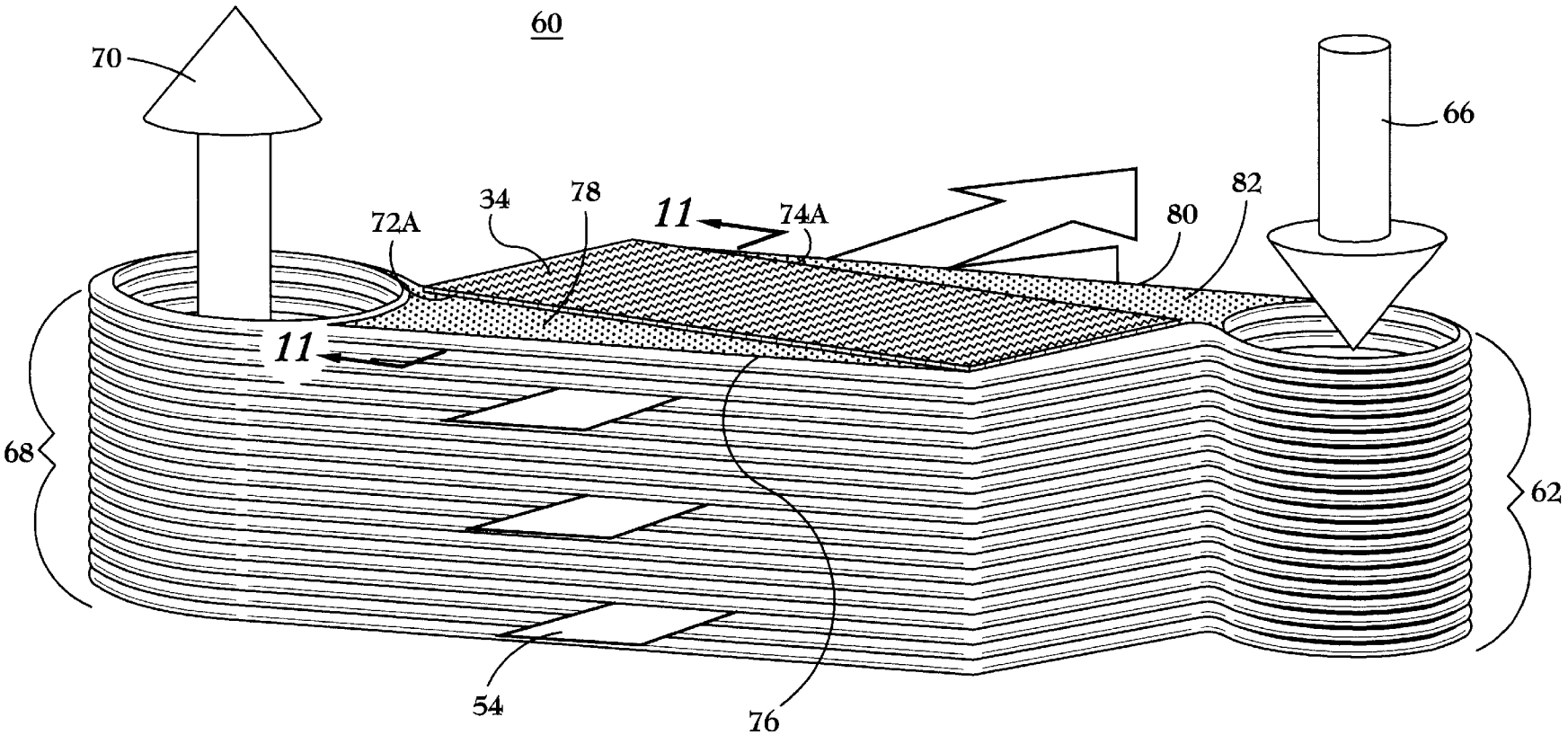
FIG. 9 shows the flow of first and external fluids through the heat exchanger of FIG. 6 in accordance with certain preferred embodiments of the present invention.
Figure 10:
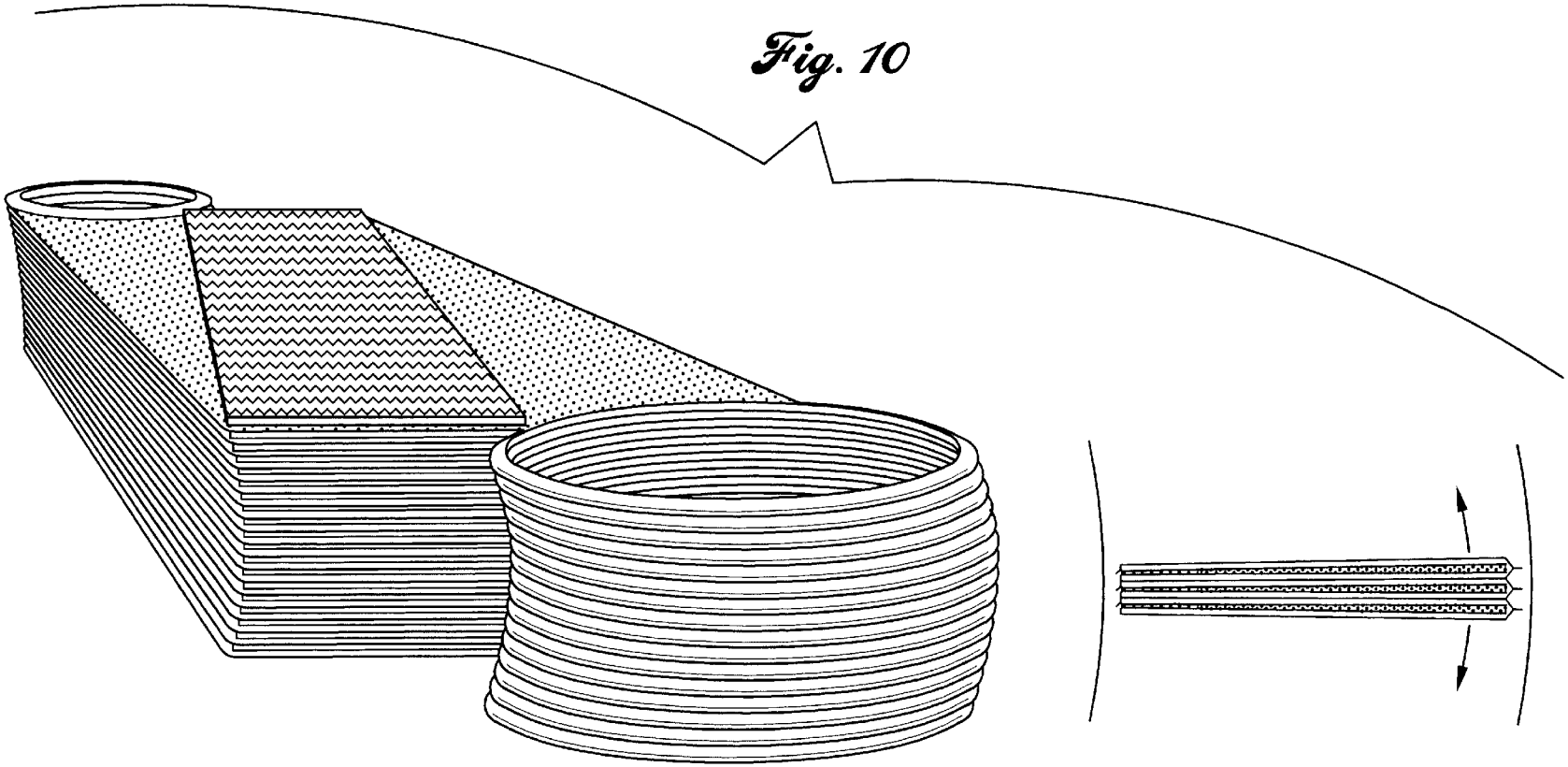
FIG. 10 shows a perspective view of the heat exchanger of FIG. 6 after thermal loading whereby the structure flexes in response to thermal forces.

Referring to FIG. 9, during operation of one preferred embodiment of the heat exchanger 60, the external fluid, such as a heated exhaust gas, travels in the direction designated 54 and through the external finned members 34 of the stacked heat exchange cells 10. At the same time, the internal fluid, such as a relatively cool compressor discharge air travels through the compliant inlet manifold structure 62 in a downward direction designated 66. Referring to FIG. 3, the internal fluid then passes in succession though the inlet manifold finned member 58A, the internal finned member 33 and the outlet manifold finned member 58B. At least some of the heat present in the external fluid is transferred to the internal fluid as the heat is transferred from the external finned members to the internal finned member. Referring to FIG. 9, the internal fluid then passes from the outlet manifold finned members of the respective cells 10 to the outlet manifold structure 68 in the direction designated 70. The temperature of the internal fluid discharged from the heat exchanger 60 is typically higher than the temperature of the internal fluid entering the heat exchanger. Referring to FIG. 10, the complaint nature of the inlet and outlet manifolds and the individual plates enables the cells of the heat exchanger to move relative to one another during operation so as to minimize the adverse affects that may result from thermal expansion and contraction. During operation, there is no need to apply external forces to the outside of each heat exchange cell 10 in order to hold the cell together because, inter alia, the internal finned member 33 is fully adhered to the top and bottom plates 12, 26 (which provides resistance against differential pressure load).

Referring to FIGS. 1, 2 and 9, in certain preferred embodiments the first and second external finned members 34A and 34B of each heat exchange cell may include substantially aligned leading edges 72A and 72B that are desirably adapted for receiving the external fluid passing between the cell layers. The first and second external finned members may also include trailing edges 74A and 74B adapted for discharging the external fluid therefrom after the external fluid has passed completely through the external finned members. The substantially aligned leading edges 72A and 72B of the first and second external finned members 34A and 34B are desirably substantially remote from a leading peripheral edge 76 of the heat exchange cell 10. In other words, Referring to FIG. 11, there exists a space or gap 78 between the aligned leading edges 72A and 72B of the external finned members and the leading peripheral edge 76 of the heat exchange cell 10. The space 78 enables the individual cells to move toward and away from one another. Referring to FIG. 2, the substantially aligned leading edges 72A and 72B of the first and second external finned members 34A and 34B may also be substantially offset from the aligned outlet apertures 22 forming the flexible outlet manifold structure 68 for also enabling each cell to deflect toward and away from a heat exchange cell adjacent thereto.

Referring to FIGS. 1, 2 and 9, in other preferred embodiments, the trailing edges 74A and 74B of the first and second external finned members 34A and 34B may also be in substantial alignment with one another and substantially remote from a rear peripheral edge 80 of the heat exchange cell 10. There preferably exists a space or gap 82 between the trailing edge 74A of the external finned member 34 and the rear peripheral edge 80 of the cell for enabling each individual cell to deflect toward and away from a heat exchange cell adjacent thereto. The substantially aligned trailing edges 74A and 74B of the first and second external finned members 34A and 34B are substantially offset from the aligned inlet apertures 20 forming the flexible inlet manifold structure 62 of the heat exchanger 60 for enabling each cell to deflect toward and away from a heat exchange cell adjacent thereto.

Figure 11:
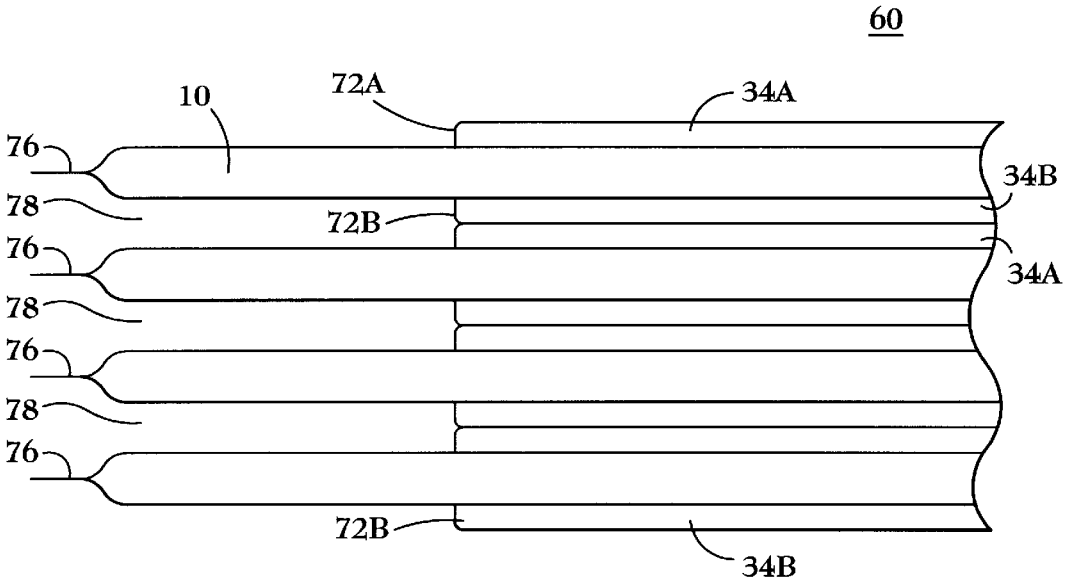
FIG. 11 shows a cross-sectional view of the heat exchanger shown in FIG. 9 taken along line XI—XI, before thermal loading.
Figure 12:
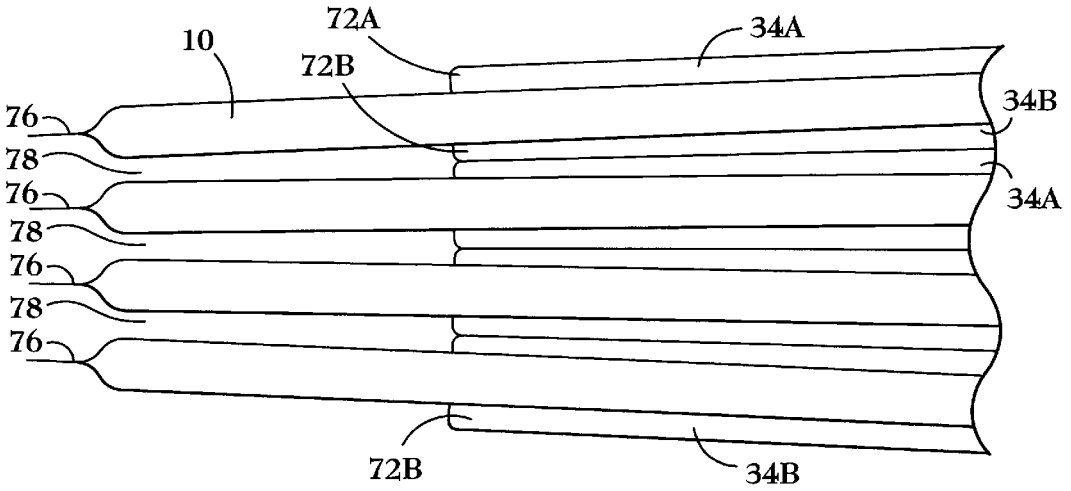
FIG. 12 shows the heat exchanger of FIG. 11 after thermal loading whereby the structure flexes in response to thermal forces.

FIG. 11 shows a fragmentary cross-sectional view of the heat exchanger shown in FIG. 9 before the bellows structures have flexed and/or bowed in response to thermal forces. The various cell layers are substantially parallel to one another because, inter alia, the heat exchanger is not under thermal stress. The leading edges 72A and 72B of the external finned members 34A and 34B are remote from the leading peripheral edge 76 of the cell, thereby providing a gap 78 that extends between the adjacent cell layers. FIG. 12 shows a fragmentary cross-sectional view of the heat exchanger of FIG. 9 after thermal loading whereby the heat exchanger flexes, bends and/or deflects in response to thermal forces. The leading peripheral edges 76 of the respective cell layers are able to move toward one another because the gaps 78 provide room into which the respective cell layers may move, thereby providing the heat exchanger with enhanced flexibility.

Figure 13:
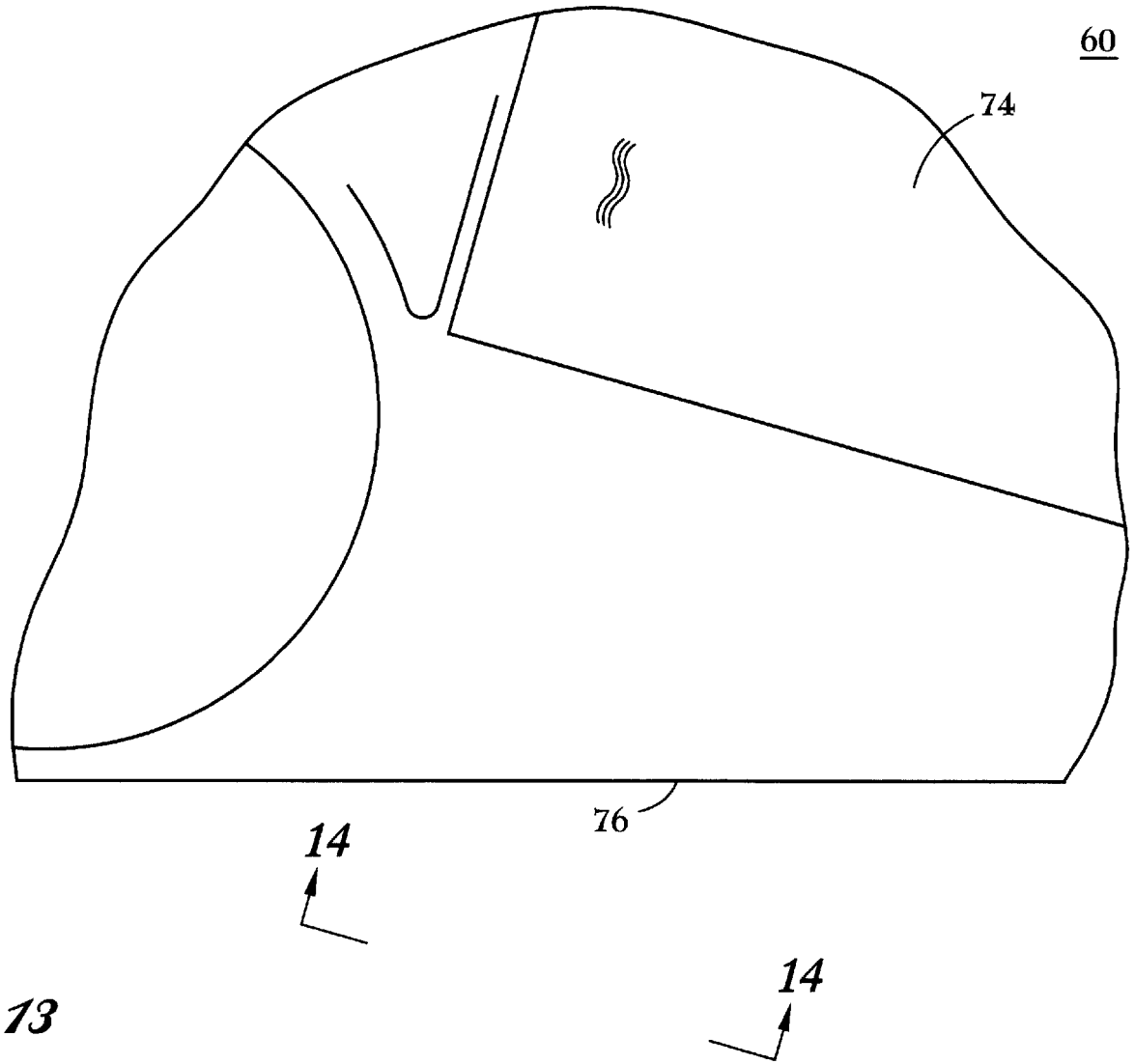
FIG. 13 shows a fragmentary top view of the heat exchanger shown in FIG. 9.
Figure 14B:
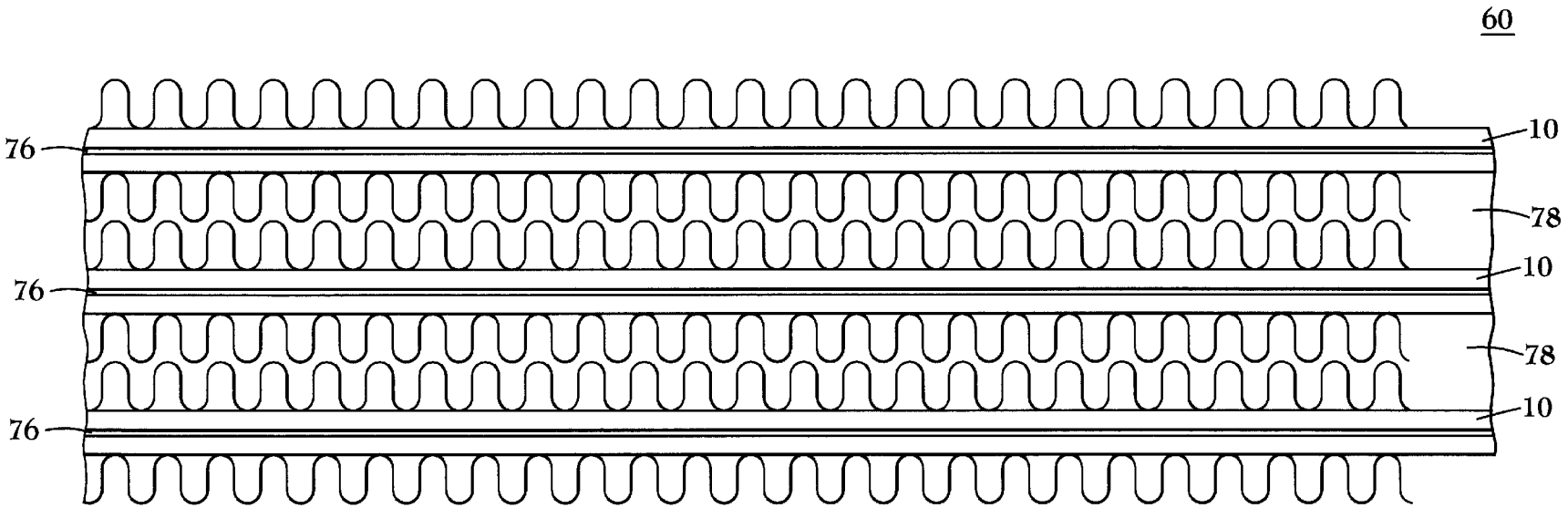
FIG. 14B shows a front view of the heat exchanger shown in FIG. 13 along line XIV—XIV when the heat exchanger is in a deflected "hot" state.
Figure 14B:
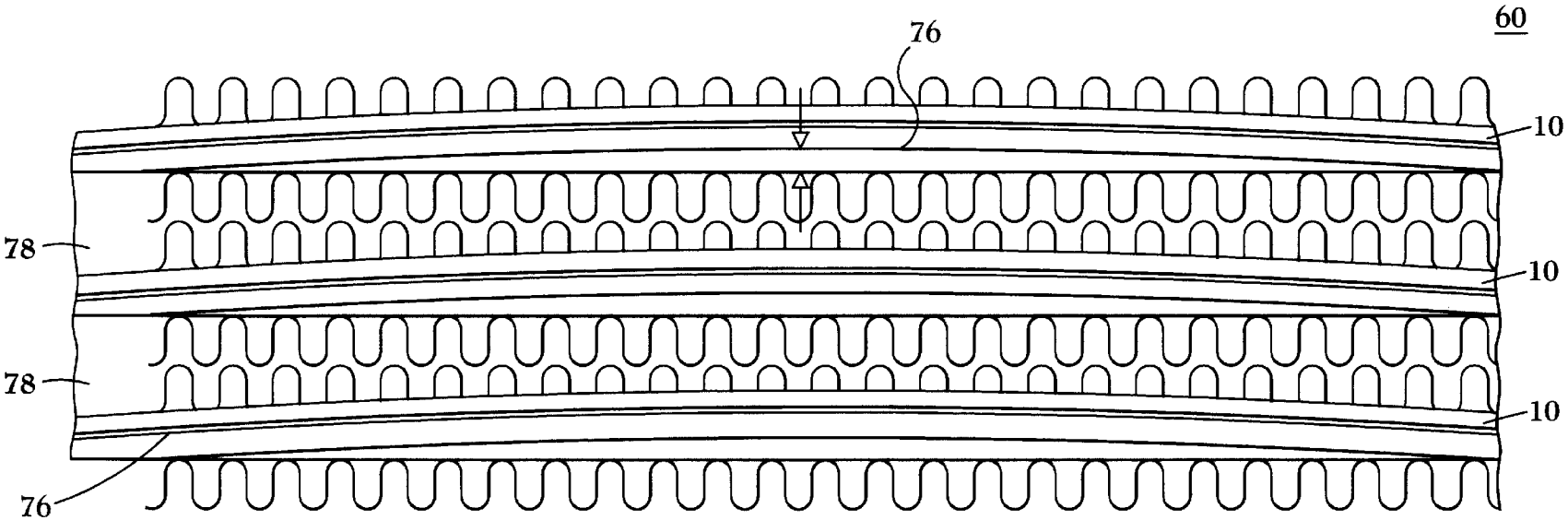

FIG. 13 shows a top fragmentary view of the heat exchanger 60 shown in FIGS. 9 and 10. FIGS. 14A and 14B show a front view of the heat exchanger 60 taken along line XIV—XIV of FIG. 13. FIG. 14A shows the heat exchanger in an undeflected "cold" state, i.e., before the cell layers 10 have flexed and/or bowed in response to thermal forces. As shown in FIG. 14A, the leading edges 76 of the various cell layers 10 are substantially flat and parallel to one another. FIG. 14B shows the heat exchanger in a deflected "hot" state, i.e., after the leading edges 76 of the respective cells layers 10 have flexed and/or bowed in response to thermal forces. As shown in FIG. 14B, at least some of the leading edges 76 have flexed and/or deflected away from cell layers adjacent thereto. As mentioned above, the leading peripheral edges 76 of the respective cell layers 10 are able to deflect toward and away from adjacent cell layers because the leading edges 76 are remote from the leading edges 72 of the external finned members 74 for forming form gaps 78 into which the respective cell layers 10 may move and/or deflect, thereby providing the heat exchanger 60 with enhanced flexibility.

In one preferred method of assembling individual heat exchange cells 10, the top and bottom plates 12, 26 (also known as parting plates) are formed from 0.010–0.050 inch stainless or super alloy steel sheet in roll form. The sheet is unrolled and then the plates are formed by stamping and laser trimming. The external finned members 34 and gas turning fins 52 are formed from 0.003–0.010 inch rolled stainless or super alloy steel. The metal is unrolled, the fins are folded and braze coating is sprayed onto one side of the external finned member 34 and the gas turning fin 52. The braze coated external finned member 34 and gas turning fin 52 are then laser trimmed and cleaned. Instead of applying a braze coat to the external finned member 34 and gas turning fin 52, the first surfaces 14, 28 of the respective top and bottom plates 12, 26 may be coated with the braze coating. The internal finned member 33 and the inlet and outlet manifold finned members 46, 48 are formed from 0.003–0.010 inch rolled stainless or super alloy steel. The metal is unrolled, the fins are folded and braze coating is sprayed onto both sides of the internal finned member 33 and the inlet and outlet manifold finned members 46, 48. The braze coated internal finned member 33 and inlet and outlet manifold finned members 46, 48 are then laser trimmed and cleaned. Instead of applying a braze coat to the internal finned member 33 and the inlet and outlet manifold finned members 46, 48, both inside surfaces of the top and bottom plates 12, 26 may be braze coated.

The top and bottom plates 12, 26; the two external finned members 34A, 34B; the internal finned member 33; and the inlet and outlet manifold finned members 46, 48 are assembled to form an individual heat exchange cell 10. The individual pieces are tack welded to temporarily hold the pieces together. In addition, the peripheral edge of the assembled individual heat exchange cell 10 may be laser welded.

One or more assembled individual heat exchange cells 10 are then preferably placed into a braze cell where the individual cells 10 are heated to braze the coated surfaces to one another. Various brazing jig components can be used to load the individual heat exchange cells 10 to minimize any distortion of the cells 10 during the brazing process. FIGS. 7 and 8 illustrate a preferred embodiment of the top and bottom plates 12, 26, including a reservoir 54 provided in top plate 12. This reservoir 54 holds additional braze coating which will spread in the adjacent surfaces of the interior of an individual heat exchange cell 10 during the brazing process.

After brazing, each heat exchange cell 10 is pressurized to check for any leaks caused by inadequate brazing. A plurality of individual heat exchange cells 10 are then is assembled into a partial stack and the interior edges of the substantially S-shaped raised flanges 36, 38 are welded together. These partial stacks are then pressure tested again. A plurality of partial stacks are then welded together to provide a heat exchanger. Transition pieces (not shown) may be attached to outer individual heat exchange cells 10 to provide a place to connect the heat exchanger to the inlet and outlet manifolds of the equipment the heat exchanger is a part of.

The above disclosure describes only certain preferred embodiments of a heat exchanger and is not intended to limit the scope of the present invention to the exact construction and operation shown and described herein. The foregoing is considered to merely illustrate certain principles of the invention. Thus, it should be evident to those skilled in the art that numerous modifications and changes may be made to the embodiments shown herein while remaining within the scope of the present invention as described and claimed.

What is claimed is:

1. A heat exchanger for transferring heat between an external fluid and an internal fluid comprising two or more heat exchange cells, each said heat exchange cell comprising:

a top plate having an inlet aperture at one end thereof and an outlet aperture at the other end thereof, said top plate including a first surface, a second surface and peripheral edges;

a bottom plate juxtaposed with said top plate having an inlet aperture at one end thereof and an outlet aperture at the other end thereof, said bottom plate including a first surface, a second surface confronting the second surface of said top plate and peripheral edges, the peripheral edges of said top and bottom plates being attached to one another, wherein the attached top and bottom plates define a high pressure chamber between the second surfaces thereof, and said inlet and outlet apertures of said top and bottom plates are in substantial alignment with one another, the inlet and outlet apertures of said top and bottom plates including substantially curvilinear S-shaped raised flange portions extending away from the first surfaces of said plates, substantially curvilinear S-shaped raised flange portions terminating at interior edges bounding said apertures; and an internal finned member disposed between and attached to the second surfaces of said top and bottom plates, wherein said heat exchange cells are assembled one atop the other and attached to one another solely through said interior edges of said raised flanges for forming a compliant bellows structure elastically absorbing deflections produced during thermal loading so that said heat exchange cells move and flex relative to one another.

2. The heat exchanger as claimed in claim 1, further comprising two external finned members, a first one of said two external finned members being attached to the first surface of said top plate and a second one of said two external finned members being attached to the first surface of said bottom plate.

3. The heat exchanger as claimed in claim 2, wherein said top plate includes a substantially flat central region between the inlet and outlet apertures thereof and said bottom plate includes a substantially flat central region between the inlet and outlet apertures thereof, said substantially flat central regions being in substantial alignment with one another.

4. The heat exchanger as claimed in claim 3, wherein the first one of said two external finned members overlies the substantially flat central region of said top plate, the second one of said two external finned members overlies the substantially flat central region of said bottom plate, and said internal finned member is disposed between the substantially flat central regions of said top and bottom plates.

5. The heat exchanger as claimed in claim 4, wherein said internal finned member is in substantial alignment with said two external finned members.

6. The heat exchanger as claimed in claim 4, wherein the first and second external finned members of each said heat exchange cell include substantially aligned leading edges for receiving the external fluid and trailing edges for discharging the external fluid after the external fluid has passed therethrough.

7. The heat exchanger as claimed in claim 6, wherein the substantially aligned leading edges of said first and second external finned members are substantially remote from at least one leading peripheral edge of said heat exchange cell for enabling each said leading peripheral edge to deflect toward and away from a heat exchange cell adjacent thereto.

8. The heat exchanger as claimed in claim 7, wherein the substantially aligned leading edges of said first and second external finned members are substantially offset from said aligned outlet apertures for enabling each said cell to move toward and away from a heat exchange cell adjacent thereto.

9. The heat exchanger as claimed in claim 6, wherein the trailing edges of said first and second external finned members are in substantial alignment with one another, the trailing edges being substantially remote from at least one rear peripheral edge of said heat exchange cell for enabling each said rear peripheral edge to move toward and away from a heat exchange cell adjacent thereto.

10. The heat exchanger as claimed in claim 9, wherein the substantially aligned trailing edges of said first and second external finned members are substantially offset from said aligned inlet apertures for enabling said cell to deflect toward and away from a heat exchange cell adjacent thereto.

11. The heat exchanger as claimed in claim 2, wherein each said heat exchange cell is adapted for passing said internal fluid through said internal finned member in a first flow direction and for passing said external fluid through said two external finned members in a second flow direction substantially counter to said first flow direction.

12. The heat exchanger as claimed in claim 11, wherein said internal fluid includes compressor discharge gases and said external fluid includes turbine discharge gas.

13. The heat exchanger as claimed in claim 11, wherein said internal fluid includes a cooling liquid selected from the group consisting of water and oil.

14. The heat exchanger as claimed in claim 11, wherein said internal fluid includes high-pressure air and said external fluid includes low-pressure combustion products.

15. The heat exchanger as claimed in claim 2, wherein said internal finned member is disposed in said high pressure chamber so that said internal fluid passes through said heat exchanger at a higher pressure than said external fluid.

16. The heat exchanger as claimed in claim 15, wherein the aligned inlet apertures of said attached top and bottom plates provide an inlet manifold of said heat exchange cell and the aligned outlet apertures of said attached top and bottom plates provide an outlet manifold of said heat exchange cell.

17. The heat exchanger as claimed in claim 16, wherein said internal finned member has an inlet edge for receiving said internal fluid from said inlet manifold and an outlet edge for discharging said internal fluid to said outlet manifold.

18. The heat exchanger as claimed in claim 17, further comprising:

an inlet manifold finned member disposed in the high pressure chamber between said inlet manifold and the inlet edge of said internal finned member; and an outlet manifold finned member disposed in the high pressure chamber between said outlet manifold and the outlet edge of said internal finned member.

19. The heat exchanger as claimed in claim 18, wherein said inlet and outlet manifold finned members direct said internal fluid in a first or cross-flow direction and said internal finned member directs said internal fluid in a direction substantially perpendicular to said first direction so that said internal fluid passes through said high-pressure chamber in a Z-flow configuration.

20. The heat exchanger as claimed in claim 2, wherein said internal finned member is brazed to said second surfaces of said top and bottom plates.

21. The heat exchanger as claimed in claim 2, wherein said two external finned members cover respective areas of said top and bottom plates which are in substantial vertical alignment with one another, said internal finned member covering an area between said top and bottom plates in substantial vertical alignment with said two external finned members.

22. The heat exchanger as claimed in claim 2, wherein said internal finned member is adhered to said top and bottom plates for providing resistance against differential pressure load so that no external pre-loading of each said heat exchange cell is required.

23. The heat exchanger as claimed in claim 1, wherein said top and bottom plates including said substantially curvilinear S-shaped raised flange portions thereof have a substantially uniform thickness.

24. The heat exchanger as claimed in claim 1, wherein opposing said raised flange portions of said attached top and bottom plates diverge from one another.

25. The heat exchanger as claimed in claim 1, wherein said interior edges of adjacent said cells are welded together.

26. A heat exchanger for transferring heat between an external fluid and an internal fluid comprising two or more heat exchange cells, each said heat exchange cell comprising:

a top plate having an inlet aperture at one end thereof and an outlet aperture at the other end thereof, said top plate including a first surface, a second surface and peripheral edges;

a bottom plate juxtaposed with said top plate having an inlet aperture at one end thereof and an outlet aperture at the other end thereof, said bottom plate including a first surface, a second surface confronting the second surface of said top plate and peripheral edges, the peripheral edges of said bottom and top plates being attached to one another, wherein the attached top and bottom plates define a high pressure chamber between the second surfaces thereof, and said inlet and outlet apertures of said top and bottom plates are in substantial alignment with one another, the inlet and outlet apertures of said top and bottom plates including substantially curvilinear S-shaped raised flange portions extending away from the first surfaces of said plates, substantially curvilinear S-shaped raised flange portions terminating at interior edges bounding said apertures;

an internal finned member disposed between and attached to the second surfaces of said top and bottom plates; and two external finned members, a first one of said two external finned members being attached to the first surface of said top plate and a second one of said two external finned members being attached to the first surface of said bottom plate, wherein said heat exchange cells are assembled one atop the other and attached to one another solely through said interior edges of said raised flanges for forming a compliant bellows structure elastically absorbing deflections produced during thermal loading so that said heat exchange cells move and flex relative to one another.

* * * * *